US009226560B1

(12) United States Patent
Birk

(10) Patent No.: US 9,226,560 B1
(45) Date of Patent: Jan. 5, 2016

(54) HAIR STYLING DEVICE

(76) Inventor: Janel Birk, Oxnard, CA (US)

( * ) Notice: Subject to any disclaimer, the term of this patent is extended or adjusted under 35 U.S.C. 154(b) by 174 days.

(21) Appl. No.: 13/565,213

(22) Filed: Aug. 2, 2012

Related U.S. Application Data

(60) Provisional application No. 61/515,537, filed on Aug. 5, 2011.

(51) Int. Cl.
*A45D 2/14* (2006.01)
*A45D 2/36* (2006.01)

(52) U.S. Cl.
CPC ..... *A45D 2/367* (2013.01)

(58) Field of Classification Search
CPC ..... A45D 2008/004; A45D 2/02; A45D 2/08; A45D 2/10; A45D 2/122; A45D 2/125; A45D 2/127; A45D 2/14; A45D 2/145; A45D 2/146; A45D 2/148; A45D 2/18; A45D 2/24; A45D 2/2345; A45D 2/2471; A45D 2/2478; A45D 2/2492; A45D 2/38; A45D 2/367
USPC ..... 132/222–223, 226–228, 235, 270, 132/247–248, 268, 261
See application file for complete search history.

(56) References Cited

U.S. PATENT DOCUMENTS 731,861 A * 6/1903 Connell ..... A45D 2/14 132/248
1,377,655 A 5/1921 Begas
1,491,415 A 4/1924 Pegelow
1,974,460 A * 9/1934 Isaacs ..... A45D 2/145 132/246
2,010,112 A 8/1935 Schneiderman
2,319,658 A 5/1943 Caldora
2,335,086 A 11/1943 Ryan
2,558,305 A * 6/1951 Marvin ..... 132/261
2,847,015 A 8/1958 Davis
3,144,027 A * 8/1964 Chalfin et al. ..... 132/245
3,159,162 A * 12/1964 Sloane ..... A45D 2/2471 132/262
3,477,449 A * 11/1969 Reiner ..... 132/262
3,533,418 A * 10/1970 Mestral ..... A45D 2/2478 132/262
3,747,610 A 7/1973 Serrat
3,835,871 A 9/1974 Roccanova
4,211,245 A * 7/1980 Coppola et al. ..... 132/268
4,249,550 A 2/1981 Cassidy
4,258,732 A 3/1981 Mariani et al.
4,284,091 A 8/1981 Ehmann
4,569,360 A 2/1986 Glucksman
4,605,019 A * 8/1986 Reynolds et al. ..... 132/272
D287,298 S 12/1986 Kibe et al.
4,829,155 A 5/1989 Fukutaka et al.
5,000,200 A 3/1991 Roberts
5,215,107 A * 6/1993 Van Divner ..... 132/248

(Continued)

*Primary Examiner* — Todd E Manahan
*Assistant Examiner* — Brianne Kalach
(74) *Attorney, Agent, or Firm* — Sandy LipKin

(57) ABSTRACT

A hair styling device or curler used to shape hair by capturing a tress of hair inside a continuous channel of the curler created by a wrapping element spirally wrapped around a central core element. The continuous channel captures the hair so it is self-holding and does not require additional clips or fixation elements to hold the curler in place. The curler may contain two elements or one element. The curler may be wrapped in either direction to accommodate styling both sides of the head and may be modularly connected to another curler to customize the length of the curler. The curler may be heated by a variety of means or may be left at room temperature for air drying. The curler may contain a blow dryer element, sensors or other smart technology to start or stop any function of the styling system.

24 Claims, 8 Drawing Sheets

(56) References Cited

U.S. PATENT DOCUMENTS

| | | | | | |
|---|---|---|---|---|---|
| 5,309,928 | A | | 5/1994 | Longoria | |
| 5,365,953 | A | * | 11/1994 | Feughelman | 132/231 |
| 5,626,156 | A | * | 5/1997 | Vicory, Sr. | 132/229 |
| 5,692,528 | A | | 12/1997 | Brenn-Albertoni | |
| 5,740,820 | A | | 4/1998 | Stern | |
| 5,862,813 | A | * | 1/1999 | Bugane | 132/252 |
| 6,006,759 | A | * | 12/1999 | Goodwin | 132/250 |
| D457,268 | S | | 5/2002 | Kwong | |
| 6,412,495 | B1 | | 7/2002 | Belman et al. | |
| 6,450,176 | B1 | | 9/2002 | Yokokawa | |
| 7,082,949 | B2 | | 8/2006 | Julemont | |
| 7,121,285 | B2 | | 10/2006 | Kraus | |
| 7,325,552 | B1 | | 2/2008 | Wilkie | |
| 2004/0069316 | A1 | | 4/2004 | Kraus | |
| 2006/0093337 | A1 | * | 5/2006 | Chan | 392/385 |
| 2007/0017541 | A1 | | 1/2007 | Wilmore | |
| 2011/0284020 | A1 | * | 11/2011 | Tam | 132/211 |

* cited by examiner

HAIR STYLING DEVICE

REFERENCE TO PRIOR APPLICATION

This application claims the priority of provisional application 61/515,537, filed Aug. 5, 2011 entitled HAIR STYLING DEVICE by Janel Birk.

BACKGROUND OF THE INVENTION

Drying and styling one's hair is a daily activity that is time consuming and often leads to a result that is unpredictable and not ideal. Being able to style one's hair quickly with predictably good results is highly desirable. The hair styling tools that are currently on the market have not changed much with the exception of some minor improvements. For example, hot rollers, roll brushes, blow dryers and curling irons are pretty similar to those that have been available for the last several decades. Each styling tool has its benefits and drawbacks.

With hot rollers, it is difficult to afffix the end of a tress of hair on the roller, without getting stray ends that protrude, which makes the final shape hard to control. Hot rollers use gentle heat, which is less damaging to hair, and through allowing the roller to cool in the hair, long lasting curls are achieved. Hot rollers also require a clip or pin to hold the curler in the hair once it is rolled into place. Conversely, a curling iron captures the hair easily with a clip arm, but requires you to hold each curl on the iron for a set amount of time, which can be time consuming. Also, due to the high heat of the barrel, one cannot curl the hair close to the scalp for root lift, and high temperatures can damage hair. Roll brushes give good shape and style and capture hair fairly easily on the brush, but also require time to hold the brush in the hair for each curl. It is also difficult to get tight curls with a roll brush and spiral curls are almost impossible.

A device that easily captures hair with a predictable shape and can be placed quickly in the hair with a low potential for damage is desirable. The invention listed herein describes a device that allows for good capture and control of the hair while applying a shape. In some cases, heat may be used to aid in setting the shape, or no heat may be used while allowing hair to dry naturally to set the shape to reduce the potential for hair damage.

SUMMARY OF THE INVENTION

The preferred embodiment of the instant inventions teaches a hair styling device comprising: a core element; and a wrapping element wherein the wrapping element wraps around the core element in a spiral shape creating a continuous channel along the length of the core element where one portion of the wrapping element comes into proximity of another portion of the wrapping element.

The above embodiment can be further modified by defining that the hair styling device is heated.

The above embodiment can be further modified by defining that the core element is hollow.

The above embodiment can be further modified by defining that the hair styling device is heated.

The above embodiment can be further modified by defining wherein steam is applied to the hair styling device.

The above embodiment can be further modified by defining wherein a fixation element is included in one or more portions of the hair styling device.

The above embodiment can be further modified by defining wherein a modular connection element is used to connect the core element of a first hair styling device to the core element of a second hair styling device such that said wrapping elements found on the first core element and the core element of the second hair styling device maintain a continuous spiral.

The above embodiment can be further modified by defining wherein the first and second hair styling devices are heated.

The above embodiment can be further modified by defining wherein the wrapping element may be hollow and include a seam open along the outer diameter thereby creating a continuous channel which can accept and capture a tress of along the length of the core element.

The above embodiment can be further modified by defining, wherein said hair styling device is heated.

The above embodiment can be further modified by defining wherein a blow drier element is placed into the hollow portion of the core element.

The above embodiment can be further modified by defining wherein a sensor is integrated into the hollow portion of the core element and is capable of sensing a parameter and sending signals.

The above embodiment can be further modified by defining wherein there is a fixed and a free end of the wrapping element wherein the free end is movable along the length of at least the core element and can be secured through a fixation element.

An alternate embodiment defines a hair styling device comprising: an elongated core with a channel cut or formed therein that forms a spiral along the length of said elongated core and is set at a depth that is capable of gripping a tress of hair and holding it thereon.

The above embodiment can be further modified by defining, wherein the elongated core is spiral shaped.

The above embodiment can be further modified by defining, wherein the hair styling device is heated.

The above embodiment can be further modified by defining wherein the core is hollow.

The above embodiment can be further modified by defining, wherein the hair styling device is heated.

The above embodiment can be further modified by defining, wherein a modular connection element is used to connect a second hair styling device to the first hair styling device such that the connection element maintains a continuous spiral channel between the first and second hair styling device.

The above embodiment can be further modified by defining, wherein the device is heated.

A second alternate embodiment defines a method of curling comprising the steps of: providing a hair styling device further comprising: a core element; and a wrapping element wherein the wrapping element wraps around the core element in a spiral shape creating a continuous channel along the length of the core element where one portion of the wrapping element comes into proximity of another portion of the wrapping element; collecting a tress of hair to be curled in the hair styling device; capturing said tress of hair in the continuous channel at one end of the hair styling device; wrapping said tress inside the continuous channel along the length of said core element; allowing said curl to set with time or heat; and removing said hair styling device from said tress.

The above embodiment can be further modified by defining wherein heat is applied to the hair styling device.

The above embodiment can be further modified by defining wherein the core element has a hollow center.

The above embodiment can be further modified by defining wherein heat is applied to the hair styling device.

The above embodiment can be further modified by defining wherein steam is applied to said hair styling device.

The hair styling device disclosed herein sets a shape in the hair by capturing the hair in a channel created by a wrapping element of the device and in most cases does not require additional clips or fixation to hold the hair styling device, as defined as a curler, in the hair. In the preferred embodiment, the hair styling device is composed of 2 main elements: 1) a wrapping element; and 2) a core element.

In one embodiment, the hair styling device or curler is constructed with a wrapping element made from lightweight, compressible foam or other material. The wrapping element is wrapped around a central core element in a spiral so that each wrap contacts the next closest wrap or is in close proximity to the next wrap. The seam or space created between the wraps of the wrapping element and the central core creates a continuous channel where hair can be lodged or gripped therein and captured between the wraps to provide a consistent spiral shape for hair setting or curling. To apply the hair to the curler, a tress of hair is captured toward the scalp and threaded into the seam or space of the continuous spiral channel at the top of the curler. Since the hair is being placed inside the seam or continuous channel, in many embodiments, the tress is completely surrounded by the material of the wrapping element and central core element thereby allowing for increased control of the shape. The hair can then be quickly and easily threaded into the continuous spiral channel for the desired length of the hair by wrapping the hair spirally from the outer diameter of the curler. The end of the hair can also be pushed into the continuous channel so that the entire length of the hair is completely captured. This allows a tress of hair with multiple layers or lengths to be captured into the continuous channel. This is an advantage over standard hot rollers which are rolled from the bottom of the hair upward, where it is difficult to capture multiple layers of hair. Alternatively, only a portion of the length of hair may be curled by starting the curl several inches away from scalp or allowing a length of the end of the tress to remain outside of the curler to provide a variety of options for curling. Alternatively, a tress of hair can be captured at the end of the tress away from the scalp by threading the tress end into the continuous channel of the hair styling device and then wrapping the tress inside the continuous channel along the length of the curler until the hair is captured towards or near the scalp. The allows the hair wrap to start at either end of the tress of hair.

In one embodiment, the wrapping element and central core element may both be cylindrical in shape. Alternatively, the wrapping element or central core element could take several different shapes and what is shown in the figures is not intended to be limiting. The cross-section of either element could be an oval, a square, a rectangle, a triangle, a trapezoid, a parallelogram or a polygon. It can be symmetrical or asymmetrical. It could be hollow or it could have elements that overlap the previous wrap. The core element could also be a tapered along the length for a tapered curl. The core element could also be a spiral along the length.

In another embodiment, the wrapping element and core element may be seamlessly integrated into a single element. In this embodiment, the hair curler is a single element curler with a channel that may be cut, formed or created in the core to integrate the two elements as a single element.

The embodiments curlers as describes above have advantages over traditional hot rollers, curlers or round brushes. The curler is self-holding and allows for fixation of the hair without additional clips. The curler allows for fast application to the hair, and the user then does not have to hold the curler in place as is the case with a curling iron or roll brush. The user places the curler as desired and then waits for the curl to set, at which point the curlers are removed. The curler is also lightweight and has material properties such that it does not pull hair during the application or removal. Another major advantage is that since the hair is evenly surrounded by material along the length of the hair, there is greater heat distribution around the tress of hair and even heating along the hair. Heat can be applied to the curler by a variety of means, such as a blow drier, heating on a heating rack, or by an integrated heating element in the curler. A heating rack could consists of a series of heated rods, or it could be a rack that applies heat the curlers by heated air, steam, heating elements, infrared, induction or a variety of heating means. By heating the material of the single element curler, or central core element and/or the wrapping element of a two-element curler which surrounds the hair, a more consistent and durable shape will be achieved without having to use excessively high temperatures, but temperatures adequate to curl the hair. In some embodiments, the curler will remain in the hair, and the hair will be allowed to transition from a heated state to a cooled state to improve the shape setting performance. The curler could also be formed from absorbent or hydrophilic materials. By completely surrounding the hair and compressing the hair in an absorbent material, faster drying and shape setting can be achieved. Where heat and absorption properties are combined, even faster drying and shape setting can be performed. The curler could also be constructed from materials to increase air flow for air drying of the hair.

Materials

The wrapping element or central core element could be solid, hollow, porous, inflatable, have a channel along the length or any combination of the above. For the comfort of the user, it is preferred for the curler to be lightweight and therefore be composed of lightweight materials and construction. For example, a solid could be a lightweight closed-cell foam, while a porous material would be an open-celled foam or mesh. A solid could also be a solid mass of polymer or elastomer or other suitable material. A porous material could also be a mesh, woven material, wire form or a solid material with openings or any combination thereof. A solid material may provide greater mass to retain heat for curling the hair. A porous material or structure may allow greater air flow to encourage drying in the case of damp or wet hair. The material could also be formed from a mesh or woven structure or could be molded from a material with holes punched therethrough afterwards to optimize the weight, heating and air flow properties. The wrapping element could be made of materials that act to insulate the heat applied to the central core element which may retain heat for a longer period. This insulation could protect the user's fingers and increase the comfort to the user while applying the curler by making the exterior of the curler a temperature that is easy to handle.

The wrapping element and central core elements of the curler could be made of a variety of materials including foams, sponges, polymers, elastomers, silicone, silicone foams, shape memory materials, super elastic materials, metals, wire forms, composites, waxes, petroleum based materials, synthetics, fabrics, natural materials (boar hair, grains, oils, etc.) or a combination thereof. A material could also contain metal flakes, powder, or other high heat conducting materials to improve the heat retention, conduction or convection of the material, while still being lightweight for user comfort. Metals or polymers could also be used to improve the spring properties or rigidity of the materials while foam or polymers could be used for compressibility. A variety of material properties could be combined to optimize performance. Coatings or materials such as ceramics, tourmaline or materials with ionic properties could be incorporated to improve the hair drying or hair conditioning properties to either the wrapping or central element. Other coatings or materials could be applied to either the wrapping or central core element to change the surface texture or finish to improve the grip or release of hair from the curler. Such coatings or both properties could be incorporated in different locations to optimize performance. Coatings such as parylene, teflons or other coatings could add lubricity to a surface to reduce hair sticking or drag. Other coatings, materials or sheaths could also be applied to reduce the buildup of static electricity.

Druing and Heatinq

The tress of hair could be applied to the curler while wet, semi-wet or dry. In the case of wet or semi-wet hair, the curlers could be left in temporarily or overnight. A standard blow drier or bonnet drier could be used to apply heat and air flow to the curler to encourage drying, shape setting or both. The foam or material of the wrapping element and/or central core element could also be hydrophilic to absorb water or water vapor to improve the speed of hair drying. The curler could also contain desiccants to improve drying. Conversely, the materials could be hydrophobic to repel water or vapor retention and release the water content through vents. Use of hydrophilic materials to improve drying would be an advantage because no heat or less heat would be required, thereby being gentler on hair and requiring less energy for an environmentally friendly design.

Alternatively, steam could be used for shape setting hair. The wrapping element and/or central core element could be constructed from open-celled foam or other steam accepting material. Steam could be applied through a central opening in the curler and/or externally to allow steam to collect in the curler. The hair could then be applied to the curler where steam could pass from the curler to the hair to shape set the hair.

Hair could be allowed to dry at room temperature in the curler or the curler could be heated to encourage faster drying. Hair could also be applied to the curler when dry, and the curler could be heated for shaped setting the hair. The curler could be heated by an external heating means or could contain an integrated heating element in the curler that is activated before or after the curler is placed in the hair. Similar to traditional hot rollers, the curler could be placed on a heating rack or heating rod to heat the curler prior to placing it into the hair. In one embodiment, the heating rack may contain multiple heated rods where the core element of the curler has a hollow core that slides over the heating rod to directly heat the core. Since the hair is being placed inside the seam or continuous channel, in many embodiments, the tress is completely surrounded by the material of the wrapping element and central core element. Where heat is applied to the curler, there is the opportunity for the tress of hair to be surrounded by heat along the length of the spiral for improved shape setting.

In some embodiments, it may be an advantage to heat the curler in a microwave, oven or other heating means. The curler could also contain an integrated heating element that is powered by a battery or other self-contained power source. The integrated heating element could also be temporarily connected to wall power until the curler is heated. For example, the integrated heating element could have an integrated solar cell that uses light to power the heating element. It could also be powered by kinetic means or by harnessing human energy expenditure such as a hand crank or other human motion to provide an environmentally friendly design. In the case of a battery, the battery could be a standard battery or a rechargeable battery. The heating element could also be powered by wireless energy transfer or could be connected to a wall power source directly. The curler could also contain a modular heating element such as cylinder or sealed tube that fits into the open lumen of the central core element of the curler and can be placed into the curler and then removed. A heating rack could be a modular heating element. The curler could also combine hydrophilic and heating properties or ionic properties to perform even faster drying. Any combination of design elements, performance properties or materials mentioned in the application can be combined to optimize performance and to create a wide variety of design options.

Hair Fixation

In another embodiment, the curler may contain an additional clip, brush, retractable brush or other means of fixation at the end of the curler to capture hair for ease of application. For example, the curler may contain a small clip that holds the hair just at the end near the scalp like a curling iron, and it allows the hair to be captured in the wrapping element. In the case of very long hair, the central core of the curler may extend beyond where the wrapping element ends to allow a length of hair that extends beyond the wrapping element to wrap around the central core and then be gripped in place with a clip or other fixation means.

Removable Handle

In another embodiment, the design could contain a removable handle to improve control of applying the curler to the hair. The handle could modularly attach to the curler for wrapping the hair, and then be easily disconnected from the curler after the hair has been wrapped and captured by the curler. The removable handle could also contain a clip, brush, hook and loop system or other hair fixturing element to hold the end of the hair to secure it to the curler to get the hair wrap started, and then the hair fixturing element could be removed with the handle after the hair is captured in the curler. The removable handle could also supply heat to the curler to provide rapid heating prior to placing the curler in the hair. For example, the removable handle could look similar to a curling iron with a heated rod. The curler could contain a central opening such as a tube that could slide onto the heated rod for rapid heating.

Self-Contained Blow Drier

Another improvement would be to apply a blow drier element inside of the central core element of the curler to allow for self-contained air flow through the central core element in order to dry the hair from the inside out. In one embodiment, the central core element could have a lumen or opening and would be constructed of a mesh or perforated tube to allow air to pass from inside the core element to the outside. The wrapping element may also be made of a porous material, mesh or structure that allows for greater air flow to pass therethrough. The blow drier element could use standard blow drier technology. It could also use bladeless fan technology that allows air to be drawn in by a small motor to intake air at one end of the central core, and then push this air into a conical ramp or other shape to direct and pull air into the central core element of the curler for hair drying. This would dry the hair from the inside out. There could also be an integrated heating element to heat the air of the blow drier element to provide gentle heated drying of the hair on the curler. If a blow drying element was incorporated into the curler, the curler could contain a disposable battery, a rechargeable battery or another type of self-contained power source, such as a solar power cell or other. The element could also be powered by wireless energy transfer or could be connected directly to a wall power source directly.

Sensors and Smart Technology

The curler could also contain a sensor to monitor temperature, humidity, moisture, time, or other parameters or any combination that may be applicable to hair drying or curling. The sensor could monitor these parameters and suggest when hair is dry, a maximum temperature is reached or a recommended time has been achieved to indicate to shut off the blow drying element or heating element or both. It could also shut off drying, heating or could shut down other features when a parameter threshold has been achieved. It could be a smart device that self-monitors, self-learns and self-controls functions based on the monitoring.

Hair Treatments

The curler could also be made of materials that are impervious to chemicals thereby allowing for the application of chemicals or hair treatments, such as permanents or other while the hair is in the curler. This would allow for the hair to be chemically set in the spiral shape of the curler.

In another embodiment, the wrapping element may contain a shape memory material that is activated by a change in temperature. This would allow the element to change shape when heat or cold is applied. For example, a wrapping element could be completely straight at room temperature and change shape to a coiled or spiral configuration when heated, or the opposite. A variety of shapes could be achieved with differing temperature profiles and variables.

Combinations

It should be noted that any combination of features, designs, materials, or elements or any parameters described in the above specification can be combined to create a variety of possibilities, and the specification is not limited by figures or specific embodiments as described herein.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1A:
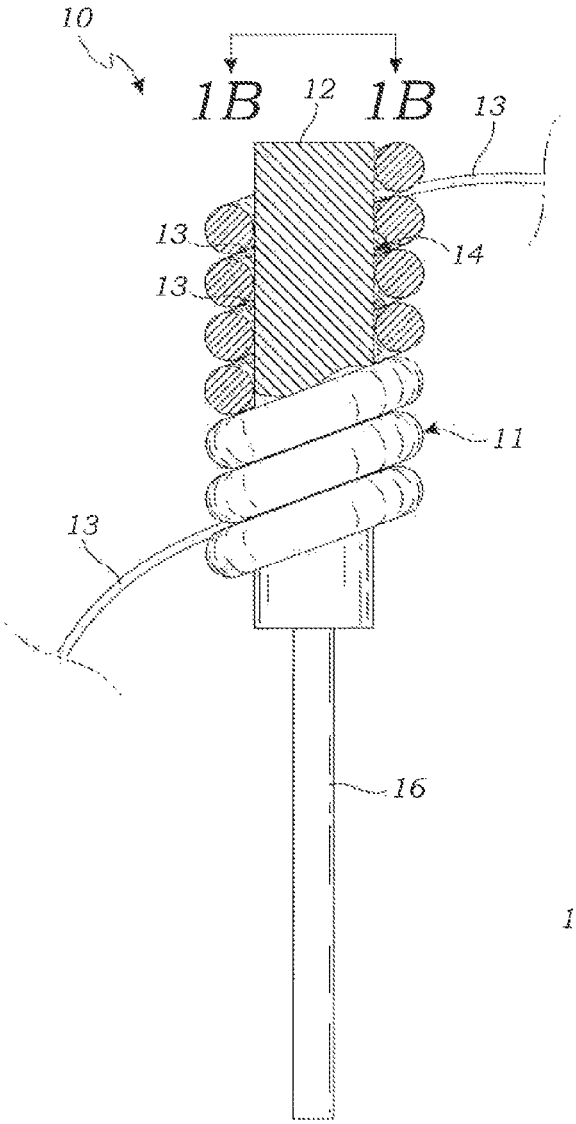
FIG. 1A depicts a partial cross-sectional side view of a two element embodiment of the curler of the present invention.
Figure 1B:
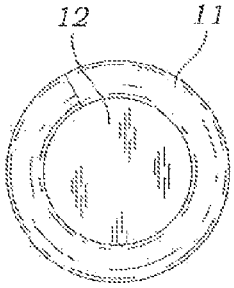
FIG. 1B depicts a top view of the embodiment shown in FIG. 1A.
Figure 1C:
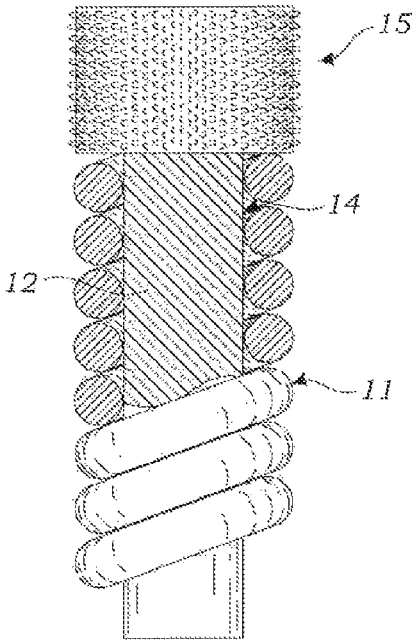
FIG. 1C depicts a partial cross-sectional side view of the embodiment shown in FIG. 1A including a fixation element.

The most basic embodiment of the curler 10 is a two element curler design with a central core element 12 and wrapping element 11 that spirally wraps around the central core element 12 as seen in FIGS. 1A, 1B, and 1C. The tress of hair is pulled into the seam between the wraps, and wedges into and is captured in the space of the continuous channel 14 created between the spiral wraps and the central core element 12 as seen in FIG. 1A. The hair 13 is then continuously wrapped into the spiral shape of the curler fitting into the seam between the spirals until the desired length has been wrapped. Although FIGS. 1A-1C show the wrapping element 11 with solid round cross section, alternative cross-sectional shapes may also be used. There could be many different shapes and what is shown here is not intended to be limiting. The cross-section could be a square, a rectangle, a trapezoid, an oval, a parallelogram, a triangle or a polygon and can be symmetrical or asymmetrical, be hollow, have a seam, or could have elements that overlap the previous wrap. The compression of the hair against the wrapping element 11 will provide adequate fixation to hold the hair in the curler without the need of an additional clip or fixation element. However, in some embodiments it may be an advantage to use a clip, hook and loop system or other fixation element 15 in order to secure the hair to the curler at either end of the curler. This could allow for a combination of shapes to be applied to the hair. For example, hair could be fixed onto a hook and loop system fixation element 15 on a round section at the beginning of the wrap to get root lift and a round shape at the scalp, and then transition into a spiral later along the curler as shown in FIG. 1C. The central core element 12 could be flexible, bendable or pivotable to allow for ease of placement. The wrapping element 11 could be fixed to the central core element 12 along the full length of the wrap along the core element or only connected in one or more locations. The wrapping element 11 could be attached to the central core element by a variety of means such as an adhesive, molding, over-molding, fasteners and the like. The central core element 12 may include extensions or features to aid in the fixation of the wrapping element 11. In an alternative embodiment, the wrapping element may be formed or shaped in a spiral and adhere to the core by friction alone, an interference fit, or by other mechanical interfits or means. The curler may have a removable handle 16 as seen in FIG. 1A to improve the control of applying the curler, or it could be placed without a handle as seen in FIG. 1C.

Figure 1D:
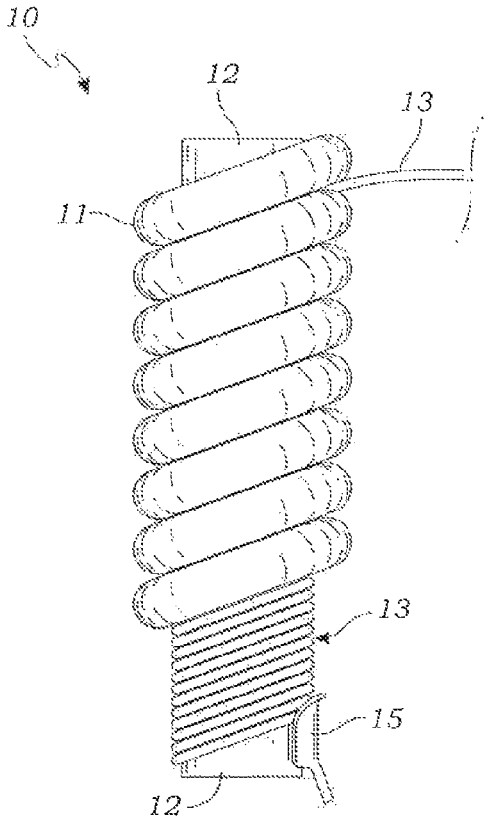
FIG. 1D depicts a view similar to FIG. 1C with a core extension for wrapping elongated hair and a clip type fixation element.

In another embodiment, the central core element 12 may extend beyond where the wrapping element 11 ends as seen in FIG. 1D. This may be advantageous for very long hair that extends beyond the length of the wrapping element 11. This would allow the hair to be wrapped around the extension of the central core and then could be fixed in place with a fixation element such as a clip 15 as shown in FIG. 1D or other fixation means. Other fixation elements may be used to hold the hair in place.

Figure 1E:
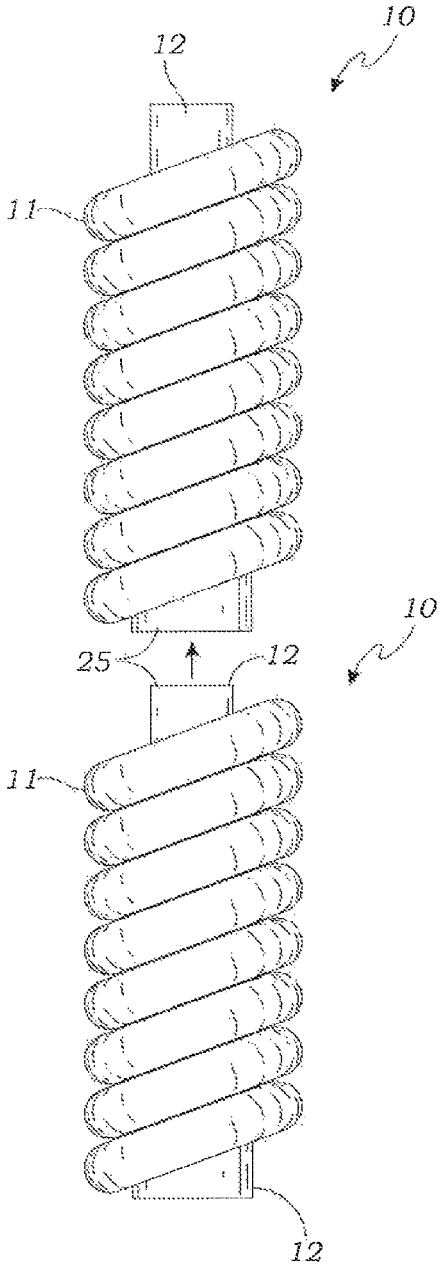
FIG. 1E depicts a side view of two devices being modularly connected with a connecting element.

In another embodiment, two or more curlers could be modularly connected to elongate the length of the curler as shown in FIG. 1E. Each curler may contain an adapting element at the end of the curler to connect it to another curler. FIG. 1E shows a modular connection element 25 on each curler along the central core element 12 to connect two curlers 10 in order to make a longer curler. Preferably, the modular connection element 25 aligns the two curlers such that the wrapping elements 11 mate to connect or align the continuous channels of both curlers. The modular feature could also be applied to a single element curler 19. (See FIG. 3A.)

Figure 1F:
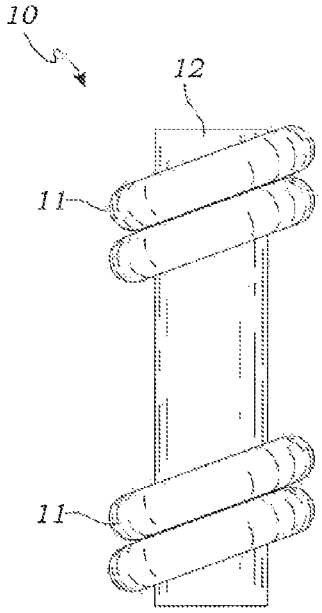
FIG. 1F depicts an alternate embodiment with wrapping elements spaced apart.
Figure 1G:
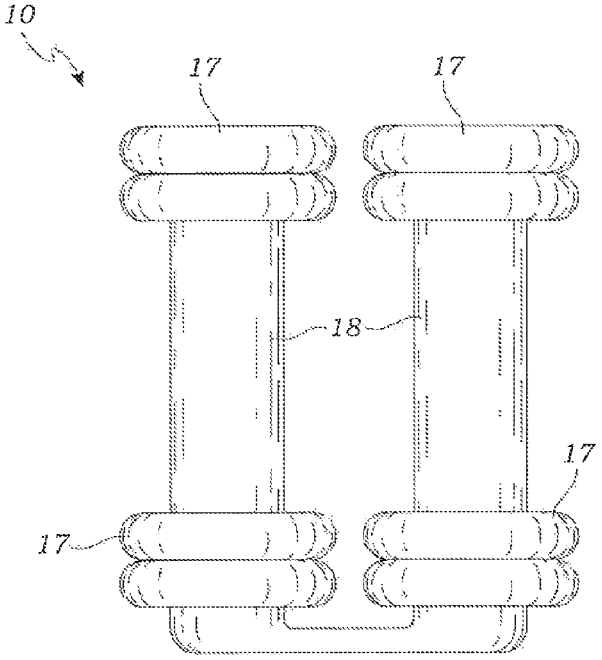
FIG. 1G depicts an alternate embodiment with double core elements.

In another embodiment, the wrapping element 11 may only be present at the ends of the central core element 12 to allow for hair capture at the top and bottom of the curler as shown in FIG. 1F. This would allow the hair to be captured in the wrapping element 11 at the top end and then wrapped around the central core, and then fixed at the opposite end. In this embodiment, the wrapping element 11 may consist of multiple members each wrapped in a spiral shape along the central core. FIG. 1F shows these as wrapped at the top and bottom of the curler. In an alternate embodiment, multiple wrapping element members may be wrapped along the full length of the core element. As previously mentioned, this could also be combined with a hook and loop system or other fixation element 15 at one end of the curler. In another embodiment, the wrapping element 11 may consist of multiple members, which may not be in a spiral pattern, but consist of two or more separate rings 17 or other shape around the central core element 12 to create a seam or channel for hair fixation. In another embodiment, the central core element 12 may consist of two or more members 18 to create a different curl or wave shape. Separate rings 17 could be placed around each central core 12 or central core members 18 to allow for hair capture. FIG. 1G shows an example of a curler with two central core members 18. This would allow hair to be wrapped around the two cores in a figure-8 pattern or oval pattern to provide a different shaped curl or wave. FIG. 1G also shows how the multiple rings 17 could be placed on central core members 18 in order to capture hair at the only at the ends. Each central core member 18 could have rings that extend the entire length of the core or could contain a continuous wrapping element along the length 11.

Figure 2A:
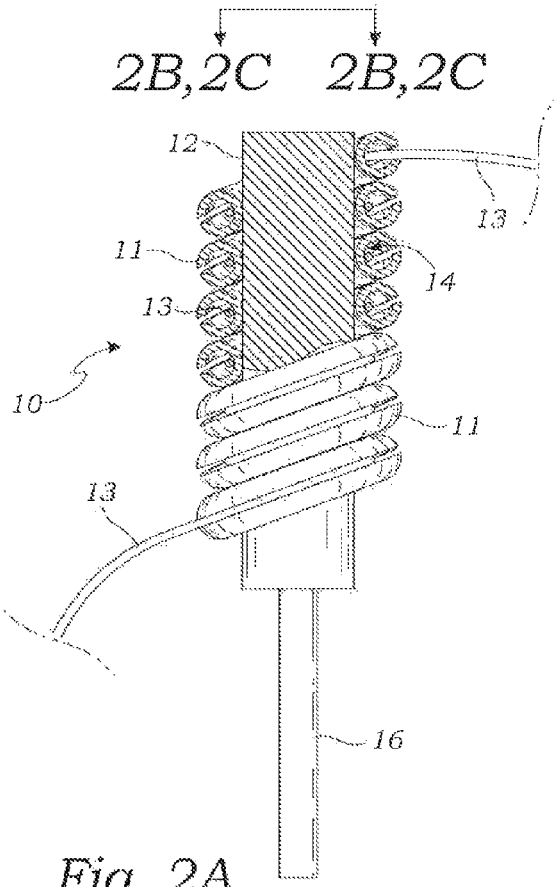
FIG. 2A depicts a partial cross-sectional view of an alternate embodiment where wrapping elements have an alternate shape and a solid core.

In another embodiment, the wrapping element 11 may have a different cross-sectional shape as shown in FIG. 2A. This figure shows an opening or channel inside the cross-section where the hair can enter inside the wrapping element 11. This is just one example of a cross-section, but there could be many different shapes and what is shown here is not intended to be limiting. The cross-section could be a u-shaped, d-shaped, c-shaped, triangular, oval, symmetrical, asymmetrical and could have elements that overlap.

Figure 2B:
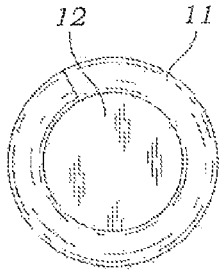
FIG. 2B depicts a top view of the embodiment in FIG. 2A.
Figure 2C:
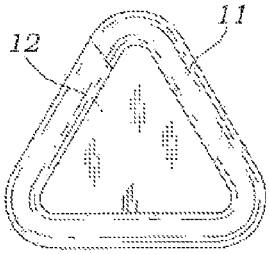
FIG. 2C depicts a top view of an alternate embodiment of FIG. 2A with a triangular shaped core element.
Figure 2D:
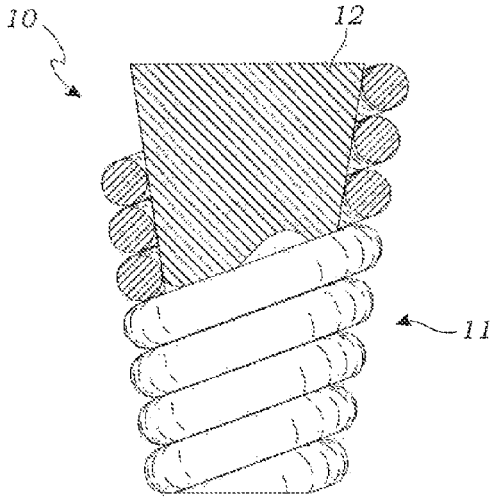
FIG. 2D depicts a partial cross-sectional side view of an alternate embodiment having a tapered conical shaped core element.
Figure 2E:
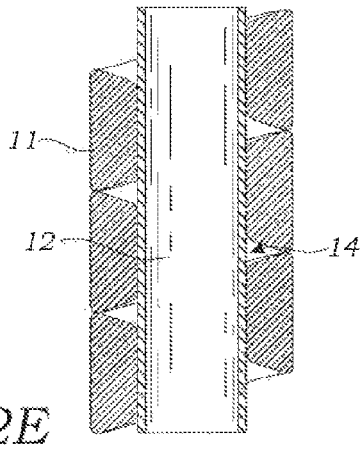
FIG. 2E depicts a side cross sectional view of an alternate embodiment of a curler of the present invention with a hollow core element.

The width of the wrapping element 11, pitch of the wrap, and diameter of the central core element 12 could also take a variety of shapes. Using a larger diameter for the central core element 12 would create larger curls while a smaller diameter central core element 12 would create smaller, tighter curls. Similarly, the pitch between the spirals could be small or large depending on the type of curls that the user would like to achieve. By using an elongated cross-section for the wrapping element, such as a trapezoid as shown in FIG. 2E, the spiral created becomes more elongated to create looser, wavier curls. The continuous channel 14 can be varied in size depending on the shape of the wrapping element such as shown in FIG. 2E with the trapezoidal shape. With a small diameter round cross-section used for the wrapping element 11 such as shown in FIGS. 1A, 1B, and 2A, the spiral curl created is a tighter, smaller spiral. The continuous channel shape 14 could also be varied depending on whether the user wanted to use a small tress of hair or a larger tress of hair 13. The wrap orientation and subsequent continuous channel 14 could also be done clockwise or counterclockwise in order to accommodate both directions of curls for each side of the head or the curler 10, 19 could contain a combination of both directions of wraps to provide a unique shape of curl or wave.

Figure 2F:
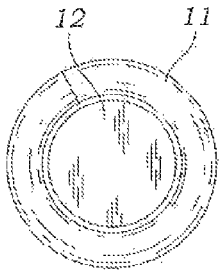
FIG. 2F depicts a top view of FIG. 2E.

In another embodiment, the central core element 12 may have different cross-sectional shapes to give a different shape curl. The central core element could be cylinder a of constant diameter to give a round spiral as shown in FIG. 2A, a side view, and 2B, a bottom view, of the same curler. The central core element 12 could also be an oval, triangle, square, FIG. 8 or other shape to provide a different shape of curl or wave. FIG. 2C shows an alternate example of the bottom view of the central core element 12 where the shape is triangular. The central core element 12 could also be constructed of a tapered profile along the length with any of the previously discussed shape in order to provide a tapered curl as shown in FIG. 2D. The central core element 12 could also have other profiles along the length such as an hourglass, a wavy profile, a spiral or other. The central core element 12 could also transition from one shape to another along the length such as from a square to a circle, or a triangle to an oval or other. The size of the shapes could also vary to allow for tapering as well. Any shape or profile could be included and what is mentioned is not intended to be limiting. The central core element 12 could be solid as shown in FIGS. 2A and 2B or be hollow as shown in FIGS. 2E and 2F. The central core element could also contain one or more openings to provide airflow for drying.

Figure 3A:
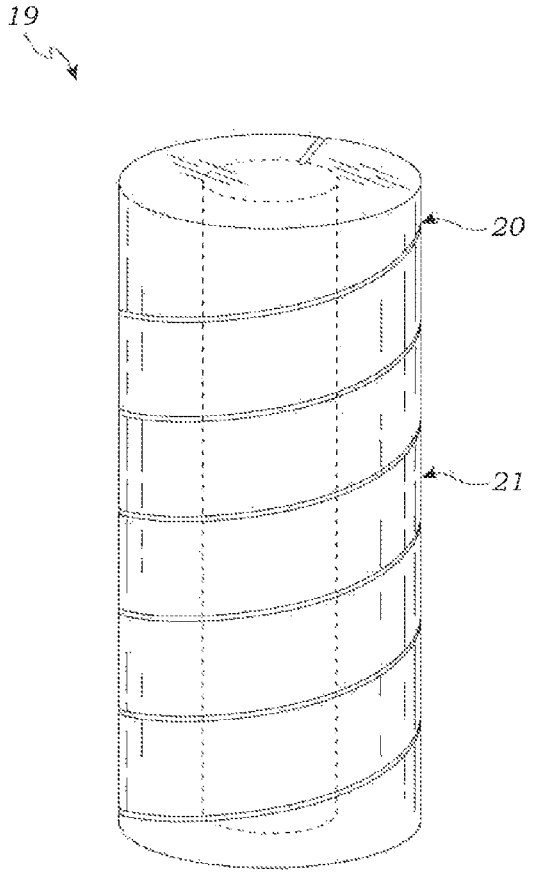
FIG. 3A depicts a single element embodiment wherein the core element combines with the wrapping element in a single piece.
Figure 3C:
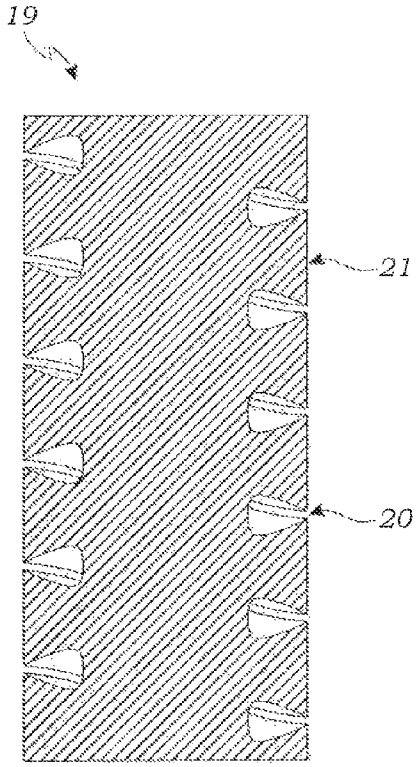
FIG. 3C depicts a cross sectional view of an alternative embodiment of a single element curler.
Figure 3B:
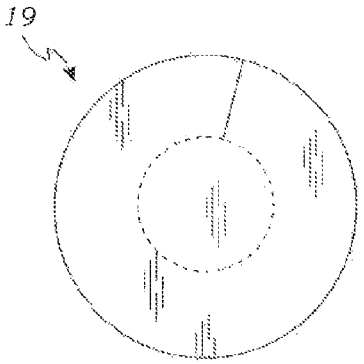
FIG. 3B depicts a top view of FIG. 3A.
Figure 3D:
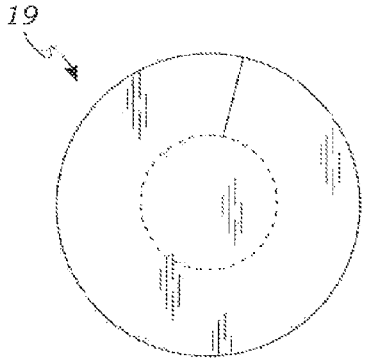
FIG. 3D depicts a top view of FIG. 3C.
Figure 3E:
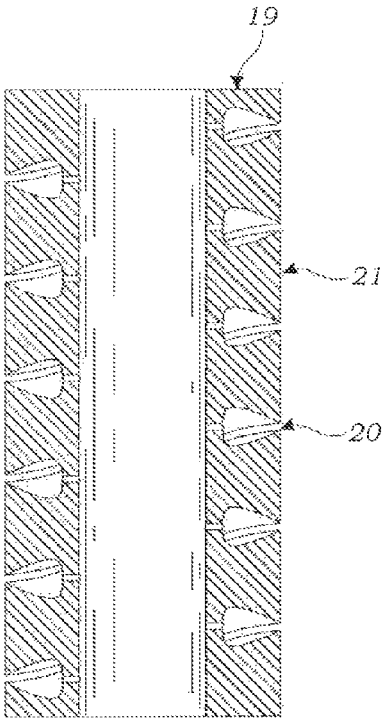
FIG. 3E is a cross sectional side view of an alternate embodiment with a central opening incorporated for air flow.
Figure 3G:
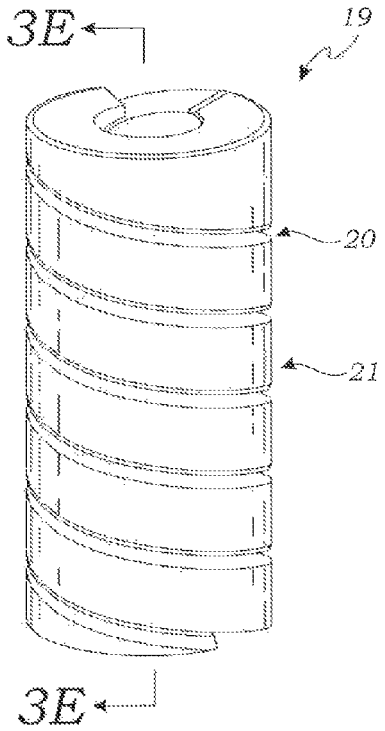
FIG. 3G depicts a perspective view of FIG. 3E.
Figure 3F:
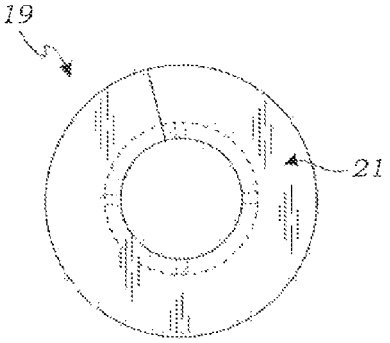
FIG. 3F depicts a top view of FIG. 3E.

In another embodiment, the spiral wrap element 11 and central core element 12 may be seamlessly integrated into a single element curler 19. (See FIGS. 3A and 3B.) This embodiment shows a solid foam cylinder with a spiral slit channel 20 cut into the side of the foam at a fixed depth along the entire length of the foam cylinder or core 21 to create a virtual cylindrical central core down the center as shown in the bottom view of FIG. 3B. As in the 2 element curler, a tress of hair can be threaded into the channel 20 and wrapped spirally along the curler length so that the channel 20 grips the hair and holds it in place without the need for additional fixation or clips. Although this FIG. 3C shows a spiral channel 20 as a slit, the profile of the channel could take many different cross-sectional shapes and could contain an opening as previously mentioned above. The cross-sectional cut or shape could be u-shaped, d-shaped, c-shaped, tear drop shaped or triangular; it could be symmetrical or asymmetrical and could have elements that overlap. As mentioned previously, the shape of the channel 20, and the core 21 could all be varied to create different shapes, and all of the options previously mentioned for a two element curler 10 apply to this embodiment for a single element curler 19 as well. What is shown in FIG. 3A is not intended to be limiting. FIG. 3C shows an alternate channel 20 with a generally triangular shape. The channel 20 could be cut or formed at a variety of depths along the length of the curler to create a virtual central core that is oval, triangular, square, a FIG. 8 or other shape to provide a different shape of curl or wave. FIGS. 3B and 3D show the bottom view of the curler and show a virtual central core that is cylindrical as shown by the dotted line. Similarly, the single element curler 19 could be molded or formed to accommodate a variety of profiles and shapes. The central core 21 could be solid as shown in FIGS. 3A-3D or it could be hollow or contain a lumen, or have opening to provide airflow and to reduce material. FIGS. 3E, 3F, 3G, 3H, 3I, and 3J show a curler 10, 19 with a central lumen or opening to allow for airflow, and also show that additional passageways or holes could connect the lumen or opening to the channel 20 for airflow. The central opening also reduces the mass and weight of the curler. In embodiments where there is a central opening or lumen, the curler 10, 19 may include an end cap to close the opening. This end cap could be incorporated into the structure of the central core such as a closed end tube or it could be a separate component that is placed into the opening. The end cap could act to retain heat, and could be constructed of material that resists heating or insulates heat to protect the user's finger while applying the curler.

Figure 3H:
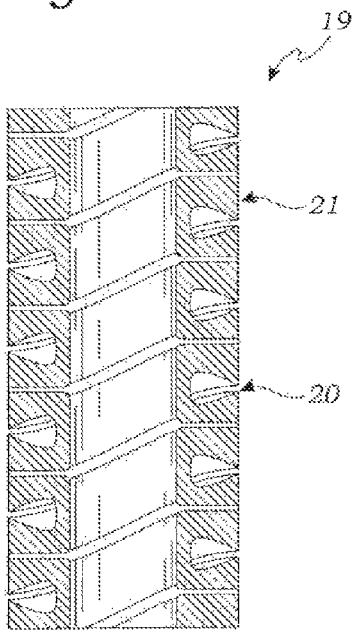
FIG. 3H depicts an alternate embodiment of a curler of the present invention.

In another embodiment of a single element curler 19, the elongated core may be extruded, molded or shaped into a spiral shape such that it may be straightened and then recoil into a spiral. FIG. 3H shows a side view of this embodiment. This embodiment may incorporate shape memory material, super elastic material or other materials such that the curler can be straightened or elongated for ease of applying the hair into the channel 20 and then allowing the material to recoil into its shape for shape setting hair. In the case of shape memory material, the curler may be straightened due to a change in temperature and then recoil with a different temperature. Alternatively, the curler 19 could be straightened with an additional tool or instrument to temporarily hold the curler 19 straight while hair is applied and then remove the tool to allow the material to recoil into the spiral shape.

Figure 3I:
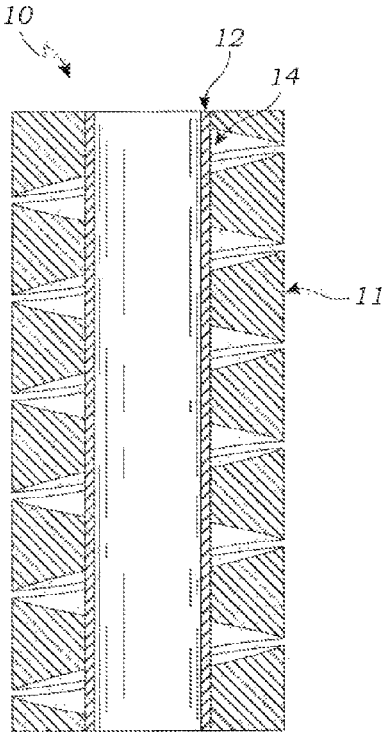
FIG. 3I depicts an alternate embodiment of a curler of the present invention with a hollow core.
Figure 3J:
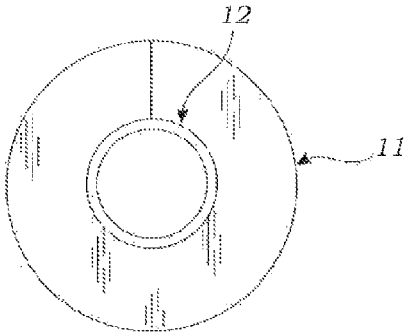
FIG. 3J depicts a top view of FIG. 3I.

In another embodiment of a two element curler 10, a core element 12 could be added to improve the structure and/or to increase airflow as shown in FIGS. 3I and 3J. FIG. 3I shows a curler 10 with a central opening where the wrapping element 11 is wrapped around a mesh central core element 12 in order to increase airflow to the captured hair. To improve the structure of the curler, capture hair and to prevent hair from passing into the central opening, a central core element 12 in the shape of a tube or material layer is added to the lumen. The wrapping element 11 and central core element 12 could be made of materials to optimize heat distribution to the hair for shape setting. The central core element 12 tube or layer could be made of a solid, mesh or perforated material, and could be metal, polymer or other or a combination thereof.

Figure 4A:
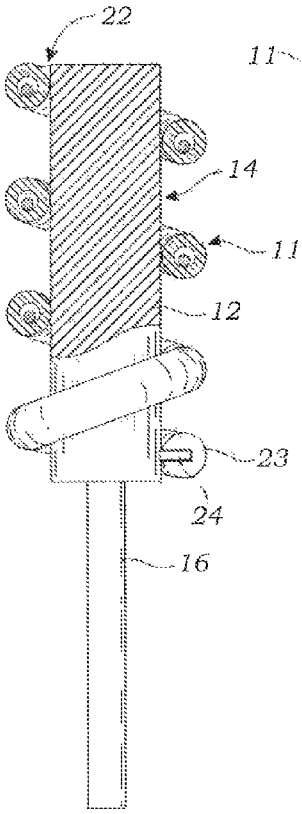
FIG. 4A depicts an alternate embodiment side view where the device has a fixed end and a free end in an expanded state.
Figure 4B:
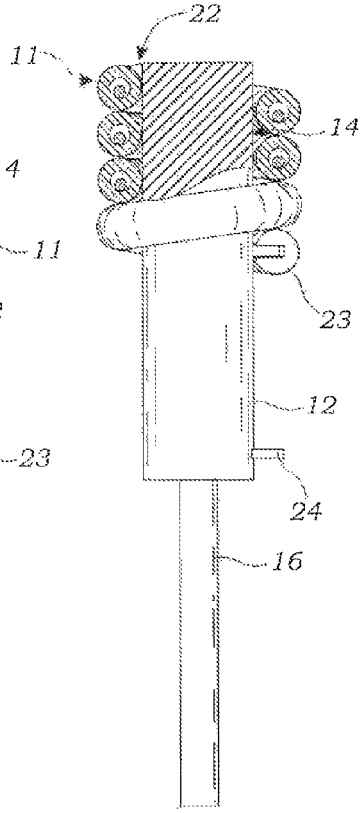
FIG. 4B depicts a view of FIG. 4A wherein the wrapping elements are in a collapsed state.

In an improvement to the above embodiments, the wrapping element 11 may only be fixed to the central core element 12 in one location to allow the wrapping element 11 to be extendable to increase the space of the continuous channel 14 between each spiral wrap. This would make the pitch of the wrap variable for an easier application of the hair with a wider space available. The wrapping element 11 could have a fixed end 22 to the central core 12, and moveable end 23 to allow the wrapping element 11 to be extended and the width between each wrap expanded. See FIGS. 4A and 4B. FIG. 4A shows the curler in the expanded configuration, while FIG. 4B shows the curler in the contracted configuration. The moveable end 23 could be pulled down and then attached to a fixation feature 24 to hold the spiral in the expanded shape as in FIG. 4A. The hair could then be applied, and then once the wrap was completed, the moveable end 23 of the spiral could be removed from the fixation feature 24 to allow the wrapping element 11 to contract into a tightly wrapped spiral as shown in FIG. 4B. The fixation feature 24 could be applied to the central core or could be located on a removable handle. The wrapping element 11 could be made of spring material or a polymer with spring qualities, or it could be a combination of a spring covered in another material or coating or other. For example, the spiral wrap element could be a foam tube with a spiral compression spring threaded through the center of the tube to create a foam covered spring as shown in FIGS. 4A and 4B. Once the spiral spring wrapping element 11 is released and compressed, it would capture the hair in between the wraps, compress the hair and fix the curler in place. As mentioned above, all of the improvements to shape, profile or fixation to any of the elements can be applied to this embodiment as well.

Figure 5:
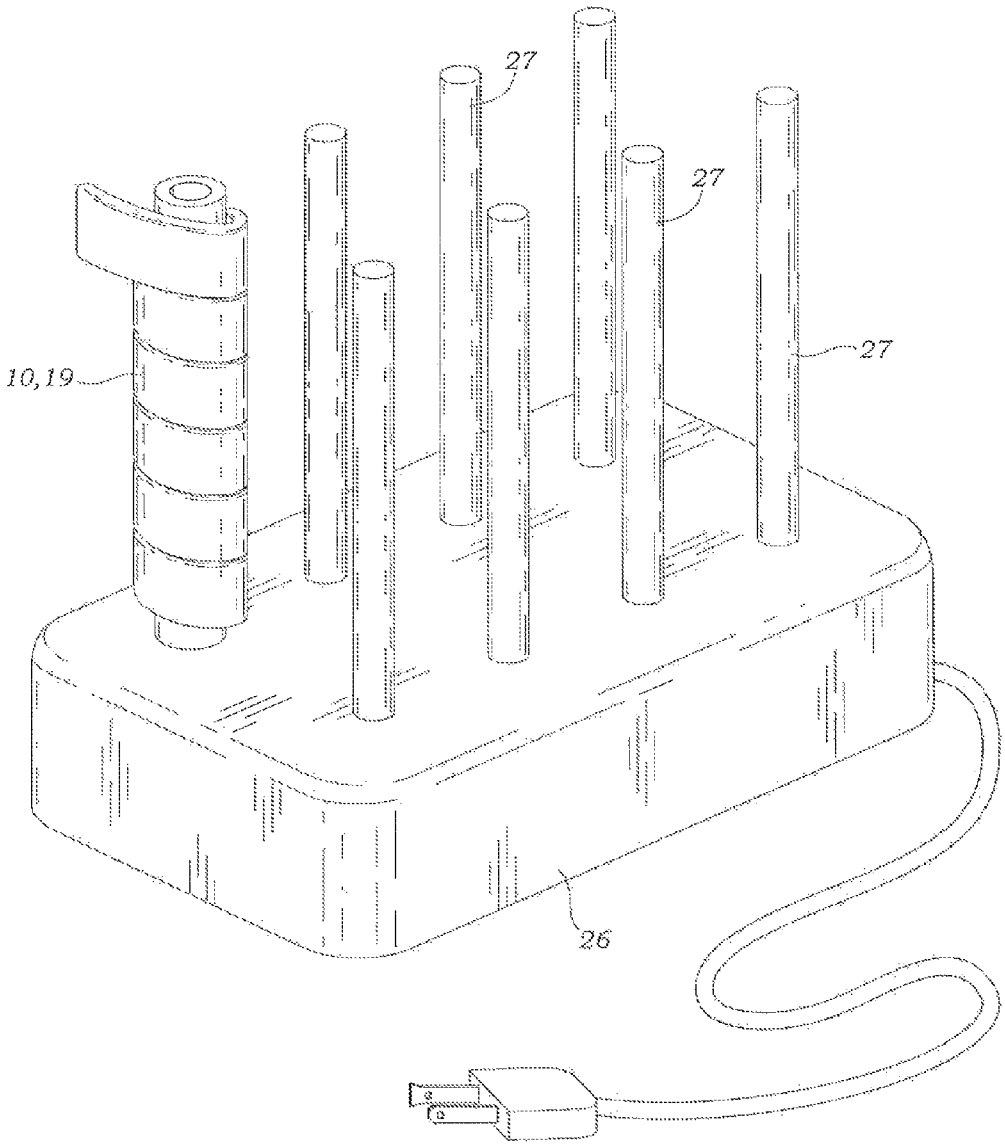
FIG. 5 is a heating rack for those embodiments with hollow cores.

All of the above embodiments could be heated or left at room temperature. In one embodiment, the curlers 10, 19 could be heated on a heating rack 26 as shown in FIG. 5. The heating rack 26 could contain one or more heating rods 27 that extend the length of the curler. The curler 10, 19 could contain a central opening that allows the curler to slide over the heating rod 27 for rapid heating. The heating rack could contain multiple controls to allow for rapid heating and maintaining the heat consistently over time. In an alternative embodiment, the rack could apply heat the curlers by heated air, steam, heating elements, infrared or light, induction or by a variety of heating means.

Alternatively, each curler could contain an integrated heating element that could be connected to a power source such as plugging into wall power or a battery or other. Each curler could contain an integrated heating element that plugs into base unit, which contains multiple plug adaptors for multiple curlers, and is connected to wall power. This would allow the curlers to connect to power for heating and then disconnect from power to place into the hair. As previously mentioned, the curler could contain additional technology such as an integrated blow drier element, smart technology such as sensors and controls to modulate the function of the curler based on specific parameters.

The foregoing description of the preferred embodiments of the invention has been presented for the purposes of illustration and description. It is not intended to be exhaustive or to limit the invention to the precise form disclosed. Many modifications and variations are possible in light of the above teaching, including but not limited to the mixing and matching of various elements described herein. It is intended that the scope of the invention not be limited by this detailed description, but by the claims and the equivalents to the claims appended hereto.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A hair styling device comprising:

a core element; and a wrapping element wherein the wrapping element wraps around the core element in a spiral shape creating a continuous channel along the length of the core element wherein the wrapping element has a cross-sectional shape where a portion of the wrapping element that contacts the core is more narrow than another portion of the cross-section of the wrapping element and thus forms a continuous channel with space where a tress of hair can be placed said tress of hair being secured therein and affixed therein in a curled shape solely by way of compressive force between the hair and said portions of the wrapping element.

2. The hair styling device of claim 1, wherein the hair styling device is heated by the application of heat.

3. The hair styling device of claim 1, wherein the core element is hollow.

4. The hair styling device of claim 3, wherein the hair styling device is heated by the application of heat.

5. The hair styling device of claim 3, wherein a blow drier element is placed into the hollow portion of the core element.

6. The hair styling device of claim 3, wherein a sensor is integrated into the hollow portion of the core element and is capable of sensing a parameter and sending signals.

7. The hair styling device of claim 1, wherein a fixation element is included in one or more portions of the hair styling device.

8. The hair styling device of claim 1, wherein a modular connection element is used to connect the core element of a first hair styling device to the core element of a second hair styling device such that said wrapping elements found on the first core element and the core element of the second hair styling device maintain a continuous spiral.

9. The hair styling device of claim 8, wherein the first and second hair styling devices are heated by the application of heat.

10. The hair styling device of claim 1, wherein the wrapping element is hollow and includes a seam open along the outer diameter thereby creating a continuous channel which can accept and capture a tress of hair along the length of the core element.

11. The hair styling device of claim 10, wherein said hair styling device is heated by the application of heat.

12. The hair styling device as defined in claim 1, wherein there is a fixed and a free end of the wrapping element wherein the free end is movable along the length of at least the core element and can be secured through a fixation element.

13. A hair styling device comprising:

an elongated core with channel having a wider portion adjacent the core than at another portion that provides a space therein that forms a spiral along the length of said elongated core and is capable of securing a tress of hair and affixing it thereon in a curled shape solely through a compressive force on the hair when placed in the space in said channel and self-hold a portion of hair thereon.

14. The hair styling device of claim 13, wherein the elongated core is spiral shaped.

15. The hair styling device of claim 13, wherein the hair styling device is heated by the application of heat.

16. The hair styling device of claim 13, wherein the core is hollow.

17. The hair styling device of claim 16, wherein the hair styling device is heated by the application of heat.

18. The hair styling device of claim 13, wherein a modular connection element is used to connect a second hair styling device to the first hair styling device such that the connection element maintains a continuous spiral channel between the first and second hair styling device.

19. The hair styling device of claim 18, wherein the device is heated by the application of heat.

20. A method of curling comprising the steps of:

providing a hair styling device further comprising:

a core element; and a wrapping element wherein the wrapping element wraps around the core element in a spiral shape creating a continuous channel along the length of the core element wherein the wrapping element has a cross-sectional shape where a portion of the wrapping element that contacts the core is more narrow than another portion of the cross-section of the wrapping element and thus forms a continuous channel with space where a tress of hair can be placed said tress of hair being secured therein and affixed therein in a curled shape solely by way of compressive force between the hair and said portions of said wrapping element;

collecting a said tress of hair to be curled in the hair styling device;

capturing said tress of hair in the continuous channel at one end of the hair styling device;

wrapping said tress inside the continuous channel along the length of said core element wherein said tress of hair is secured in said space solely via compressive force between the hair and said portions of said wrapping element;

allowing said curl to set with time or heat; and removing said hair styling device from said tress.

21. The method of claim 20, wherein heat is applied to the hair styling device.

22. The method of claim 20, wherein the core element has a hollow center.

23. The method of claim 22, wherein heat is applied to the hair styling device.

24. The method of claim 20, wherein steam is applied to said hair styling device.

* * * * *